US009768554B2

(12) United States Patent
Raschilla et al.

(10) Patent No.: US 9,768,554 B2
(45) Date of Patent: Sep. 19, 2017

(54) ADAPTABLE ELECTRICAL PLUG ASSEMBLY

(71) Applicant: DELPHI TECHNOLOGIES, INC., Troy, MI (US)

(72) Inventors: Anthony Raschilla, Girard, OH (US); Don E. Bizon, Boardman, OH (US); Rangarajan Sundarakrishnamachari, Chennai (IN)

(73) Assignee: DELPHI TECHNOLOGIES, INC., Troy, MI (US)

( * ) Notice: Subject to any disclaimer, the term of this patent is extended or adjusted under 35 U.S.C. 154(b) by 148 days.

(21) Appl. No.: 14/862,672

(22) Filed: Sep. 23, 2015

(65) Prior Publication Data

US 2017/0085032 A1 Mar. 23, 2017

(51) Int. Cl.
*H01R 13/642* (2006.01)

(52) U.S. Cl.
CPC ..... *H01R 13/642* (2013.01)

(58) Field of Classification Search
CPC ..... H01R 13/642; H01R 31/065
USPC ..... 439/170–175, 177, 372, 518, 680, 347, 439/956, 217, 166, 218, 311–314
See application file for complete search history.

(56) References Cited

U.S. PATENT DOCUMENTS

| | | | | |
|---|---|---|---|---|
| 6,669,495 | B2 * | 12/2003 | Philips | H01R 31/065 439/170 |
| 6,699,052 | B1 | 3/2004 | Poran | |
| 8,128,434 | B1 * | 3/2012 | Gandolfi | H01R 13/6666 439/620.31 |
| 8,197,260 | B2 * | 6/2012 | Wadsworth | H01R 31/065 439/13 |
| 8,951,075 | B2 | 2/2015 | Ekchian | |
| 2003/0211767 | A1 | 11/2003 | Philips et al. | |

FOREIGN PATENT DOCUMENTS

| | | | |
|---|---|---|---|
| WO | 2014144990 | A1 | 9/2014 |

* cited by examiner

*Primary Examiner* — Edwin A. Leon
(74) *Attorney, Agent, or Firm* — Robert J. Myers

(57) ABSTRACT

An electrical plug assembly including a plug housing, a ground pin and a first power blade projecting from the surface of the plug housing; and a power socket disposed within the plug housing. The surface defines an aperture surrounding the power socket. The assembly further includes an adapter plate including a second power blade having a first portion projecting from a first surface and a second portion projecting from an opposed second surface. Ground pin and first power blade apertures extend through the adapter plate. The second portion of the second power blade is received within the power socket and the ground pin and the first power blade are received within the ground pin and first power blade apertures respectively. The ground pin and the first power blade each project from the first surface of the adapter plate. The adapter plate allows the plug assembly to meet NEMA 5-15P or 6-20P standards.

20 Claims, 10 Drawing Sheets

ADAPTABLE ELECTRICAL PLUG ASSEMBLY

TECHNICAL FIELD OF THE INVENTION

The invention relates to an electrical plug assembly, particularly an electrical plug assembly adaptable to mate with various receptacles conforming to different receptacle configuration standards.

BACKGROUND OF THE INVENTION

National technical standards exist to define the physical and electrical characteristics of electrical plugs and their associated receptacles. The intent of these technical standards is to promote safety and operability between power sources and electronic devices that require electrical power. Historically, a particular electronic device would be designed for a specific source voltage and maximum current source and so would be manufactured with a fixed plug that is configured to insert into its complementary power-source receptacle. For example, an electronic device in North America requiring 220 volts and drawing a maximum current of 15 amperes would be supplied with a plug meeting the National Electrical Manufacturers Association (NEMA) 6-20 standard configured for insertion into a receptacle also conforming to the NEMA 6-20 standard. However, the NEMA 6-20 plug cannot be inserted into a receptacle capable of providing a lower 110 volt source voltage, such as a NEMA 5-15 standard receptacle.

However, electronic devices are currently being manufactured that have built-in power electronics capable of converting various input voltages into an appropriate electrical power for the device. While an electronic device might be configured with a NEMA 6-20 plug for use with a 220V supply, it may be also operable with 110V power provided by a NEMA 5-15 receptacle Current solutions have involved the inclusion of a common plug to the electronic device and the use of two different power supply cords. A first cord has a common receptacle that is designed to mate with the plug in the electronic device on one end of the cord and a NEMA 6-20 plug the other. The second cord has the common receptacle on one end and a NEMA 5-15 plug on the other. This solution requires the addition of the common receptacle to the electronic device as well as a second power supply cord, adding additional cost to the device. A lower cost solution may be desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of the invention, an electrical plug is provided. The electrical plug assembly includes a plug housing, a ground pin projecting from a surface of the plug housing, a first power blade projecting from the surface of the plug housing, and a power socket disposed within the plug housing. The surface defines an aperture surrounding the power socket. The power socket may be configured to receive a second power blade in a first orientation that is substantially parallel to the first power blade or in a second orientation that is substantially perpendicular to the first power blade.

The electrical plug assembly further comprises an adapter plate that includes a second power blade having a first portion projecting from a first surface of the adapter plate and a second portion projecting from an opposed second surface of the adapter plate. The adapter plate further defines a ground pin aperture and a first power blade aperture, each extending through the adapter plate. The second portion of the second power blade is received within the power socket and the ground pin and the first power blade are received within the ground pin aperture and the first power blade aperture respectively. The ground pin and the first power blade project from the first surface of the adapter plate when fully received within the apertures.

In accordance with another embodiment of the invention, the second power blade is in the first orientation substantially parallel to the first power blade. This electrical plug assembly meets the National Electrical Manufacturers Association (NEMA) 5-15P standard.

In accordance with yet another embodiment of the invention, the second power blade is in the second orientation substantially perpendicular to the first power blade. This electrical plug assembly meets the NEMA 6-20P standard.

The electrical plug assembly may further include a retainer configured to secure the adapter plate to the plug housing. The adapter plate may define a shroud projecting from the second surface and longitudinally surrounding the second portion of the second power blade. The shroud may be slideably attached to the adapter plate and configured to retract within the adapter plate when the adapter plate is attached to the plug housing.

In accordance with another embodiment of the invention, an electrical vehicle charging device is provided. The electric vehicle battery charging device is capable of receiving electrical power having various source voltages. The electric vehicle battery charging device includes an electrical power cord terminated by the adaptable electrical plug assembly described above.

BRIEF DESCRIPTION OF THE SEVERAL VIEWS OF THE DRAWING

The present invention will now be described, by way of example with reference to the accompanying drawings, in which.

Like elements will be indicated by the same reference number in each figure while similar elements will be indicated by the same last two digits of the reference number.

DETAILED DESCRIPTION OF THE INVENTION

An adaptable electrical plug assembly, hereinafter referred to as the plug assembly, is presented herein. The plug assembly terminates one end of a power supply cord attached to an electrical device, such as electric vehicle battery charging device, capable of receiving electrical power having various source voltages. The plug assembly includes a first adapter plate constructed to be attached to a plug housing that adapts the plug assembly to interface with a power supply receptacle conforming to a first technical standard and a second adapter plate that adapts the plug assembly to interface with a power supply receptacle conforming to a second technical standard.

As used herein, a "technical standard" is a formalized public document that defines a uniform physical and/or electrical configuration for a product, whether promulgated by a standards body, a regulatory body, or as a "de facto" standard set by widespread adoption. Technical standards include the standards established by the National Electrical Manufacturers Association ("NEMA") in the United States for use with alternating current (AC) electrical power connections, including but not limited to NEMA 5-15, NEMA 6-15, NEMA 5-20, and NEMA 6-20. Although a particular standard may have sub sections defining a receptacle configuration and plug configuration (and so designated with 'R' or 'P'), the description herein treats "a technical standard" as encompassing both receptacle and plug configurations in the same technical standard. The technical standards may also include standards defining electrical plugs and receptacles from outside of the United States.

The plug housing includes a first power blade and a ground pin configured to mate with the corresponding sockets in a NEMA 5-15R or NEMA 6-20R receptacle. The configuration of the first power blade and the ground pin is common to both technical standards. The plug housing also includes a power socket. The adapter plates each contain a second power blade that designed to mate with both the power socket of the mating NEMA 5-15R or NEMA 6-20R receptacle and the power socket of the plug housing.

Figure 1B:
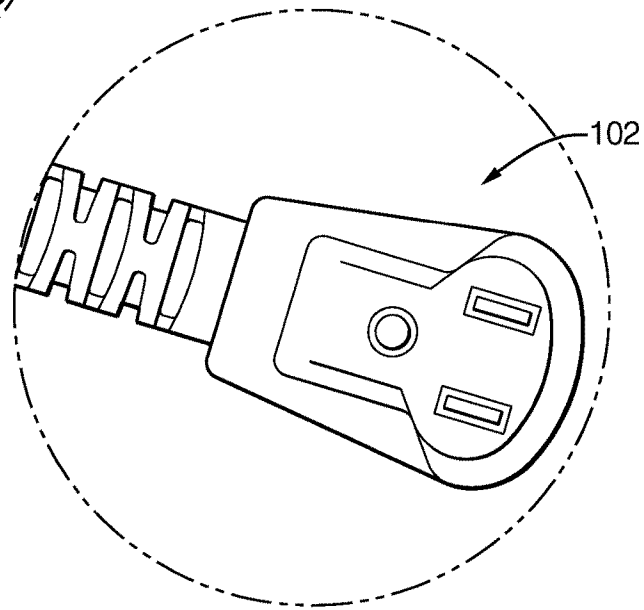
FIG. 1B is a close-up perspective view of the electrical plug assembly.
Figure 1A:
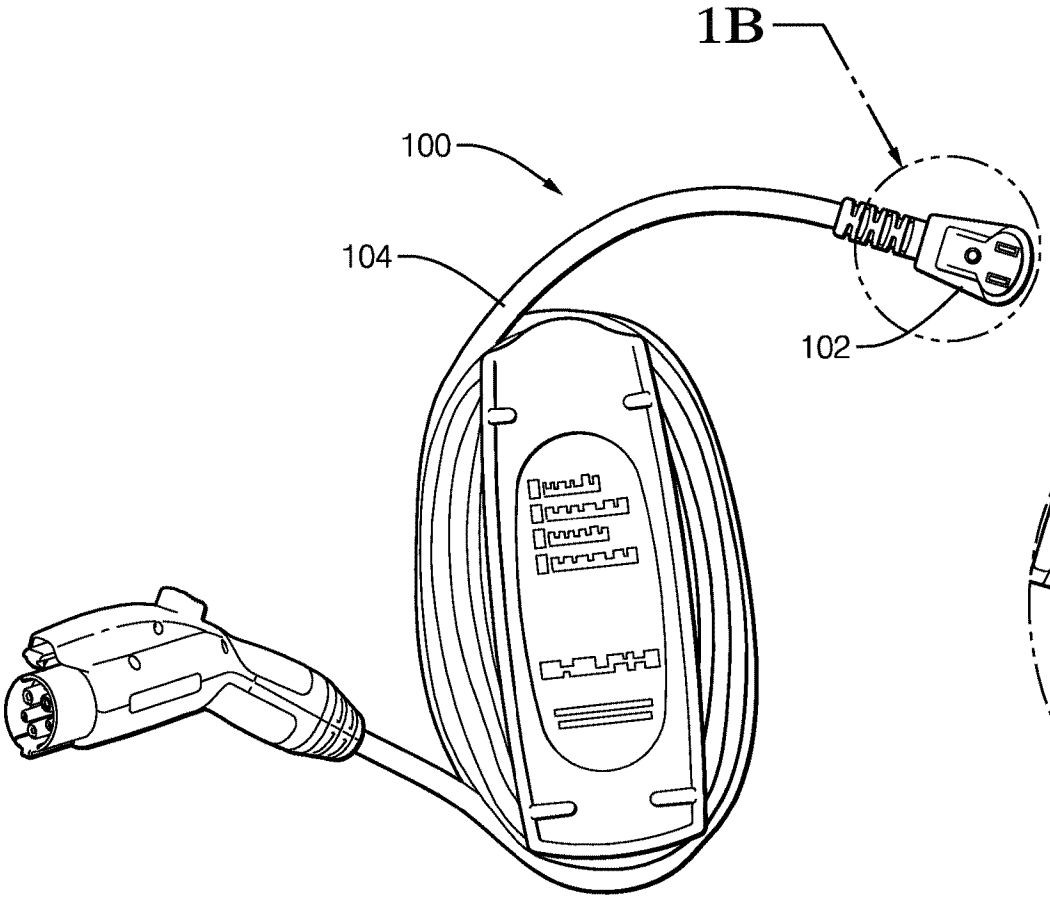
FIG. 1A is a perspective view of an electric vehicle battery charging device having a power cord terminated by an electrical plug assembly.

FIG. 1A illustrates a non-limiting example of an electronic device 100, in this case an electric vehicle battery charging device 100 that has a power supply cord 104 terminated by a plug assembly 102. The electric vehicle battery charging device 100 is designed to operate from either a 110V/60 Hz AC or a 220V/60 Hz power source (not shown). FIG. 1B provides a close-up view of the plug assembly 102 of electric vehicle battery charging device 100 in one configuration, in this example adapted to connect with a NEMA 5-15R receptacle.

Figure 2B:
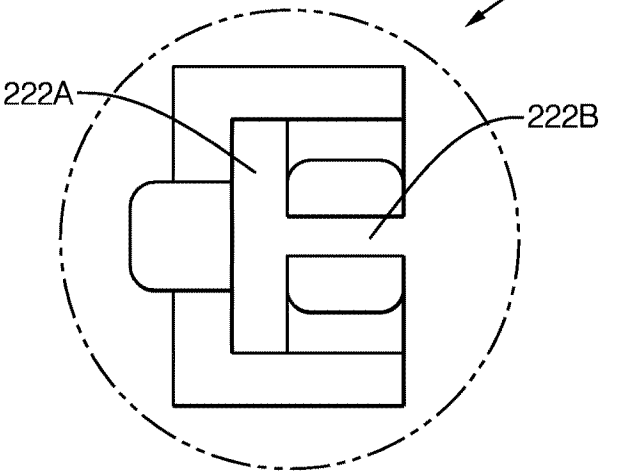
FIG. 2B is a close-up front view of a power socket of the electrical plug housing.
Figure 2A:
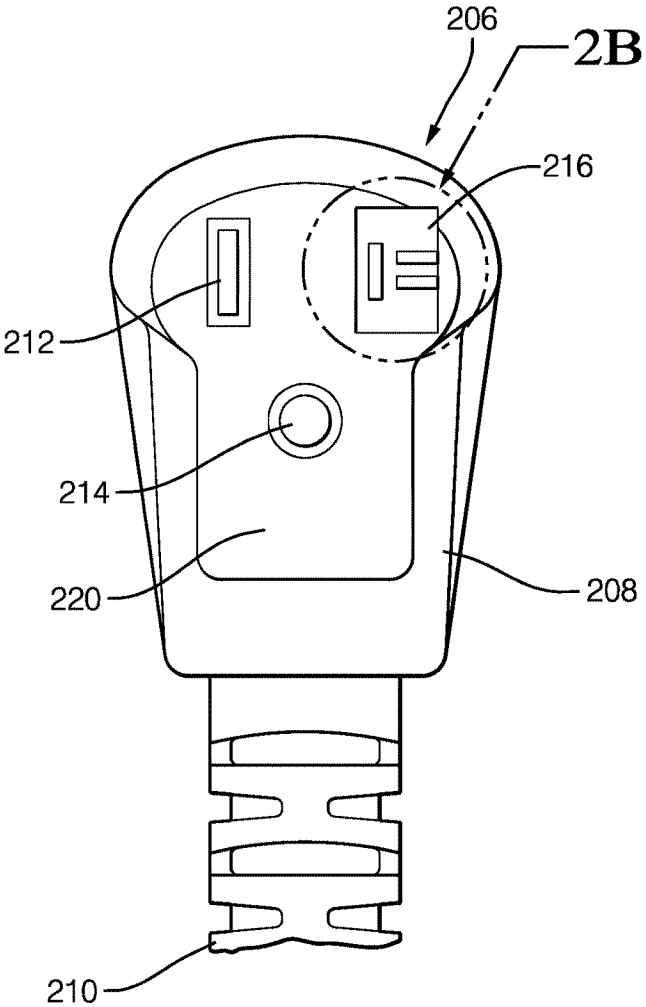
FIG. 2A is a front view of the electrical plug housing.

FIG. 2A illustrates a non-limiting example of a plug housing 206 of the plug assembly 102. The plug housing 206 includes a plug body 208 that is designed to be attached to the end of a power supply cord 104 containing a ground wire, a first power wire, and a second power wire (not shown). The plug body 208 defines a flexible strain relief device 210 that surrounds the end of the power supply cord 104 and provides protection against wire breakage due to localized flexing of the wires. The plug housing 206 also includes a first power blade 212 having a generally rectangular cross section and a ground pin 214 having a generally round cross section. The width and thickness of the first power blade 212 and ground pin 214 meet both NEMA 5-15P and NEMA 6-20P standards. The plug housing 206 further includes a power socket 216 that is designed to accept a second power blade (not shown) having a generally rectangular cross section in either a first orientation wherein the major surfaces of the sides of the second power blade is substantially parallel to the major surfaces of the sides of the first power blade 212 or in a second orientation wherein the major surfaces of the sides of the second power blade is substantially perpendicular to the major surfaces of the sides of the first power blade 212. As used herein, substantially parallel is ±5° of absolutely parallel and substantially perpendicular is ±5° of absolutely perpendicular. The first power blade 212, power socket 216, and ground pin 214 are electrically coupled to the first power wire, second power wire, and ground wire of the power supply cord 104 respectively. The ground pin 214 and first power blade 212 project substantially perpendicularly to a front surface 220 of the plug body 208. The plug housing 206 may also include a thermistor (not shown) to detect a temperature of the plug assembly 102. The electrical device 100 connected to the plug assembly 102 may be designed to take countermeasures to reduce the plug assembly temperature if it exceeds a temperature threshold.

FIG. 2B illustrates a non-limiting example of the power socket 216. A first portion 222A of the power socket 216 is configured to receive the second power blade in the first, or parallel, orientation. A second portion 222B of the power socket 216 is configured to receive the second power blade in the second, or perpendicular orientation. The power socket 216 of the plug housing 206 may be similar in design to the power socket of a receptacle conforming to the NEMA 5-20 or 6-20 standards.

The plug body 208 is formed of a dielectric material, e.g. polyvinyl chloride (PVC). The ground pin 214, first power blade 212, and power socket 216 are formed of a conductive material, such as a copper alloy.

Figure 3B:
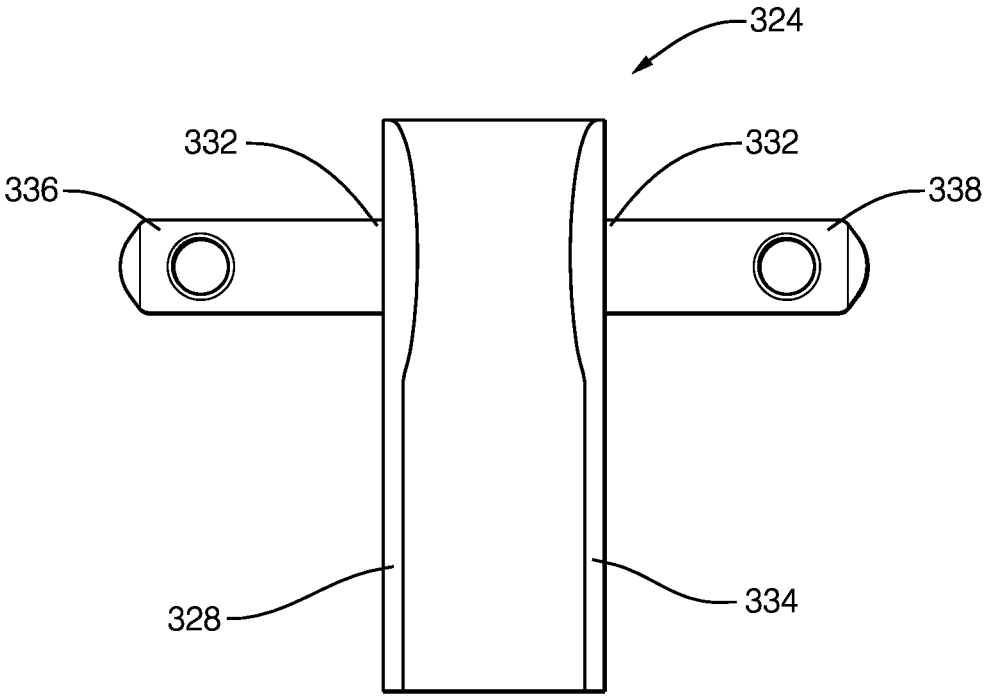
FIG. 3B is a side view of the first adapter plate of the electrical plug assembly.
Figure 3A:
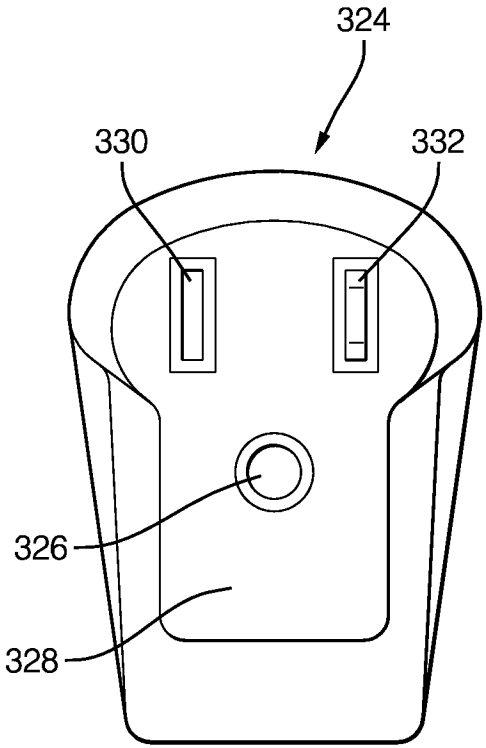
FIG. 3A is a front view of a first adapter plate of the electrical plug assembly.

FIGS. 3A and 3B illustrate a non-limiting example of a first adapter plate 324 designed to be attached to the front surface 220 of the plug housing 206 to form a plug assembly that meets the NEMA 5-15 standard. The first adapter plate 324 defines a ground pin aperture 326 having a generally round shape corresponding to the diameter of the ground pin 214 in which the ground pin 214 is received so that when the first adapter plate 324 is attached to the plug housing 206, the ground pin 214 projects from a first surface 328 of the first adapter plate 324. Similarly, the first adapter plate 324 defines a first power blade aperture 330 having a generally rectangular shape corresponding to the cross section of the first power blade 212 in which the first power blade 212 is received so that when the first adapter plate 324 is attached to the plug housing 206, the first power blade 212 projects from the first surface 328 of the first adapter plate 324. When the first adapter plate 324 is attached to the plug housing 206, the ground pin 214 and first power blade 212 project substantially perpendicularly to the first surface 328 of the first adapter plate 324. The lengths of the ground pin 214 and first power blade 212 projecting from the first surface 328 meet NEMA 5-15 standards.

The first adapter plate 324 also includes a second power blade 332 that extends through the first adapter plate 324 extending perpendicularly from the first side 328 and from a second surface 334 that is opposed, or opposite, the first surface 328. The second power blade 332 has a generally rectangular cross section. The width and thickness of the second power blade 332 meets the NEMA 5-15P standards. A first portion 336 of the second power blade 332 projects substantially perpendicularly from the first surface 328 of the first adapter plate 324 and a second portion 338 of the second power blade 332 projects substantially perpendicularly from the second surface 334 of the first adapter plate 324. The second power blade 332 of the first adapter plate 324 is received within the first portion 222A of the power socket 216 that is parallel to the first power blade 212 so that the major surfaces of the sides of the first portion 336 of the second power blade 332 is substantially parallel to the major surfaces of the sides of the first power blade 212. The length of the first portion 336 of the second power blade 332 projecting from the first surface 328 meets NEMA 5-15 standards.

The front surface 220 of the plug housing 206 and the second surface 334 of the first adapter plate 324 define complementary shapes. Both surfaces may be substantially planar. When the second power blade 332 is fully mated within the power socket 216, the second surface 334 of the adapter plate 324 is in substantially intimate contact with the front surface 220 of the plug housing 206.

Figure 4B:
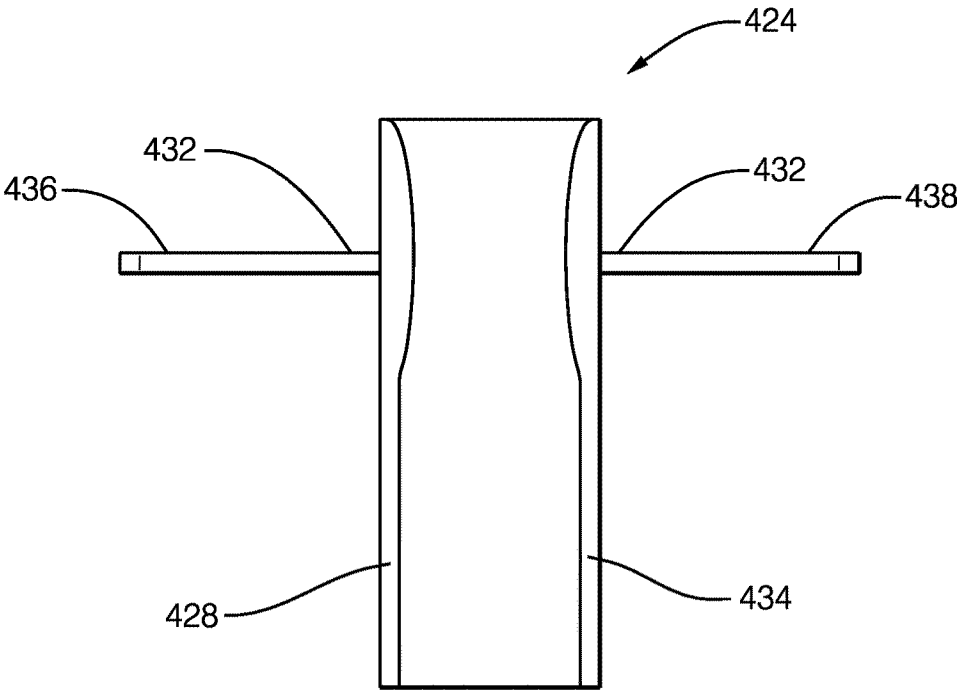
FIG. 4B is a side view of the second adapter plate of the electrical plug assembly.
Figure 4A:
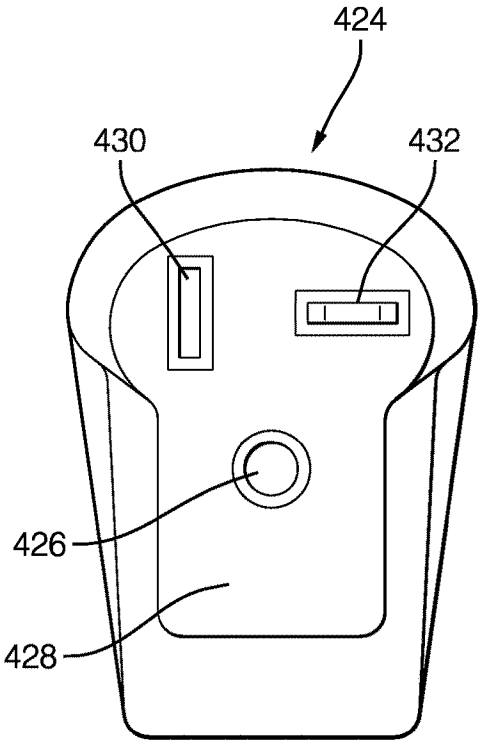
FIG. 4A is a front view of a second adapter plate of the electrical plug assembly.

FIGS. 4A and 4B illustrate a non-limiting example of a second adapter plate 424 designed to be attached to the front surface 220 of the plug housing 206 to form a plug assembly that meets the NEMA 6-20 standard. The second adapter plate 424 shares the same overall shape and ground pin aperture 426 and first power blade aperture 430 have the same shape and location as the first adapter plate 324. When the second adapter plate 424 is attached to the plug housing 206, the lengths of the ground pin 214 and first power blade 212 projecting from the first surface 428 meet NEMA 6-20 standards.

The second adapter plate 424 differs from the first adapter plate 324 in that the second power blade 432 of the second adapter plate 424 is received within the second portion 222B of the power socket 216 that is perpendicular to the first power blade 212 so that the major surfaces of the sides of the first portion 436 of the second power blade 432 is substantially perpendicular to the major surfaces of the sides of the first power blade 212. The length of the first portion 436 of the second power blade 432 projecting from the first surface 428 meets NEMA 6-20 standards. The length of the second portion 438 of the second power blade 432 projecting from the second surface 434 may have a shorter length than the first portion 436 of the second power blade 432.

The adapter plates 324, 424 are formed of a dielectric material, e.g. polybutylene terephthalate (PBT). The second power blades 332, 432 are formed of a conductive material, such as a copper alloy. The second power blades 332, 432 may be insert molded within the adapter plates 324, 424.

Figures 5A, 5B, 5C:
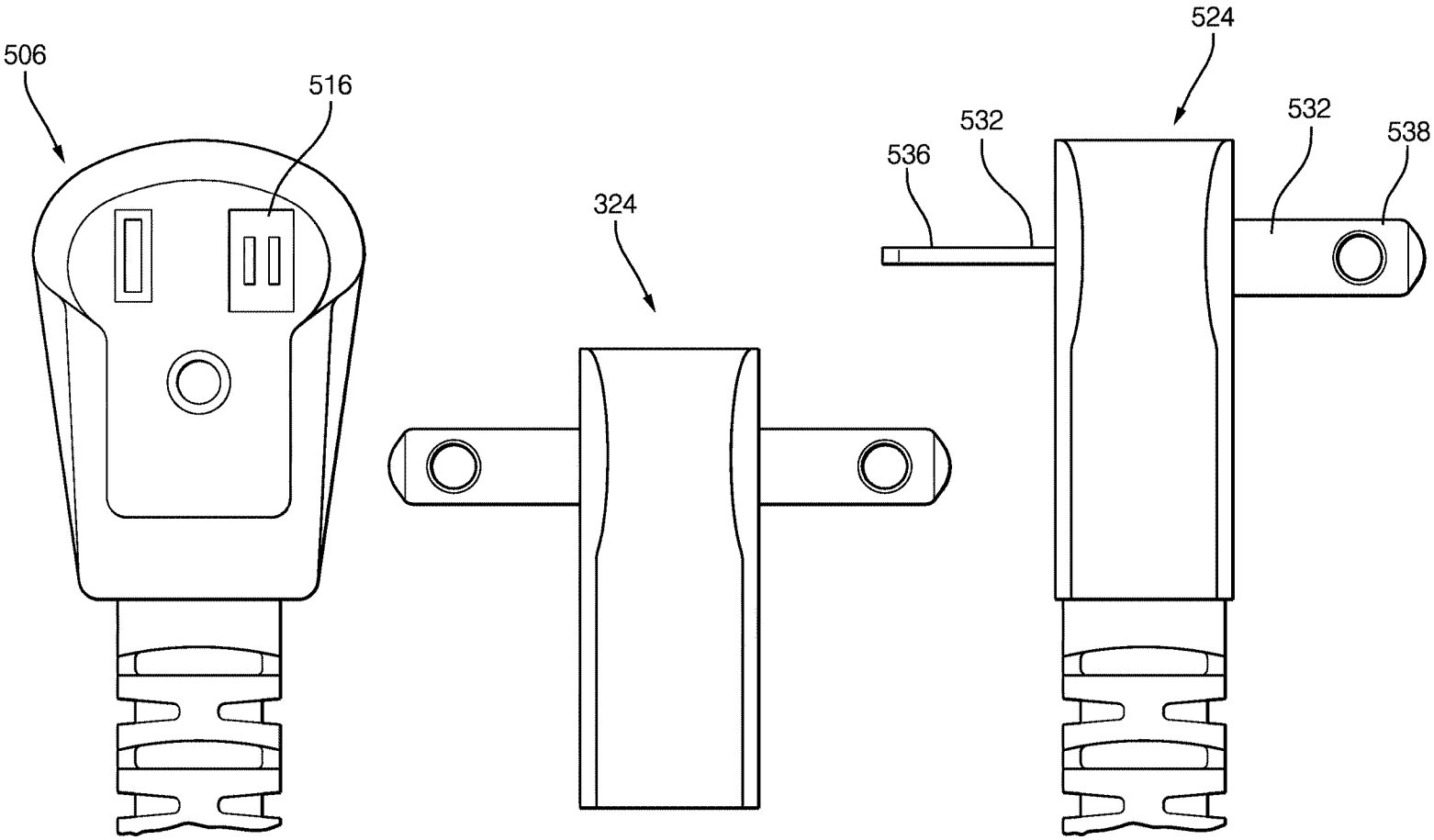
FIG. 5A is a front view of an alternative electrical plug housing.
FIG. 5B is a side view of an alternative first adapter plate.
FIG. 5C is a side view of an alternative second adapter plate.
Figure 6C:
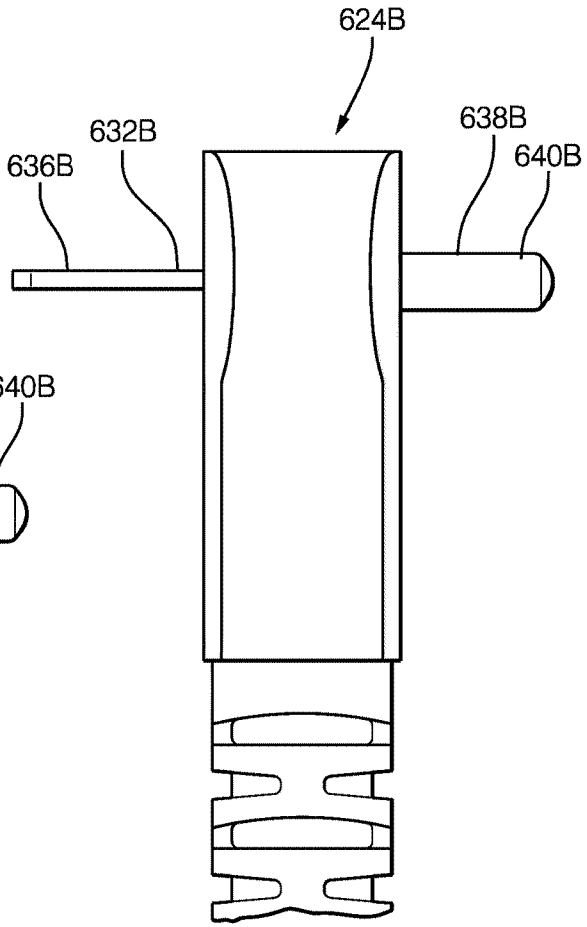
FIG. 6C is a side view of another alternative second adapter plate.
Figure 6B:
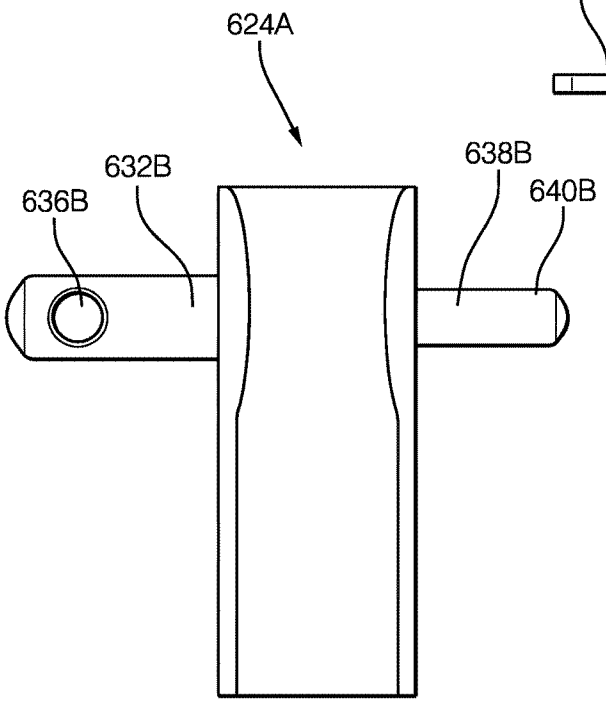
FIG. 6B is a side view of another alternative first adapter plate.
Figure 6A:
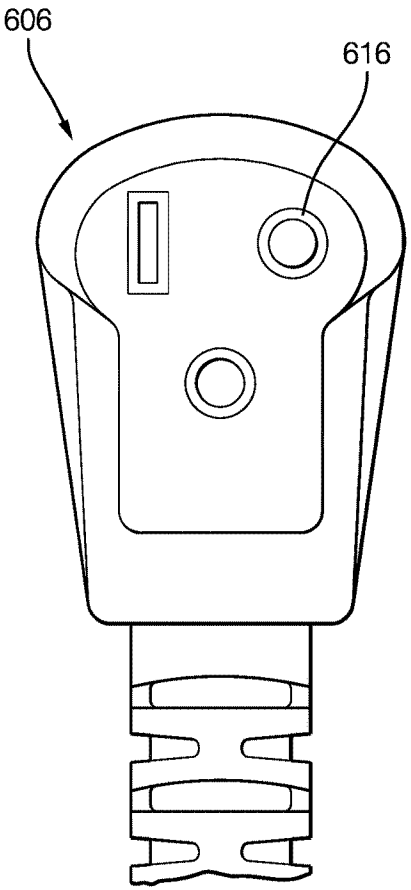
FIG. 6A is a front view of another alternative electrical plug housing.

FIGS. 5A-6C illustrate alternative embodiments of the plug assembly. A first alternative embodiment is shown in FIGS. 5A-5C. The plug housing 506 has a power socket 516 with a single vertical receptacle. In this case, the first adapter plate 324 remains unchanged from the embodiment shown in FIGS. 3A and 3B. The second adapter plate 524 differs in that the second portion 538 of the second power blade 532 has a vertical orientation rather than the horizontal orientation of the second portion 438 shown in FIG. 4B. The first portion 536 of the second power blade 532 retains the horizontal orientation of the first portion 436 shown in FIG. 4A. A second alternative embodiment is shown in FIGS. 6A-6C. The plug housing 606 has a power socket 616 with a round receptacle. In this case, the second portion 638A, 638B of the second power blades 632A, 632B of the first and second adapter plates 624A, 624B are a ground pin 640A, 640B having a round cross section and configured to mate with the round power socket receptacle. The first portion 636A of the second power blade 632A of the first adapter plate 624A retains the blade shape and vertical orientation of the first portion 336 shown in FIG. 3A. The first portion 636B of the second power blade 632B of the second adapter plate 624B retains the blade shape and horizontal orientation of the first portion 436 shown in FIG. 4A.

The adapter plates 324, 424 shown in FIGS. 3A-4B provide a manufacturing cost advantage over the embodiments of the adapter plates 524, 624A, 624B shown in FIGS. 5A-6C since the second power blades 332, 432 can be stamped from a flat sheet of conductive material and do not require and additional forming operations as would be required for the second power blades 532, 632A, 632B shown in 5A-6C.

Figure 7B:
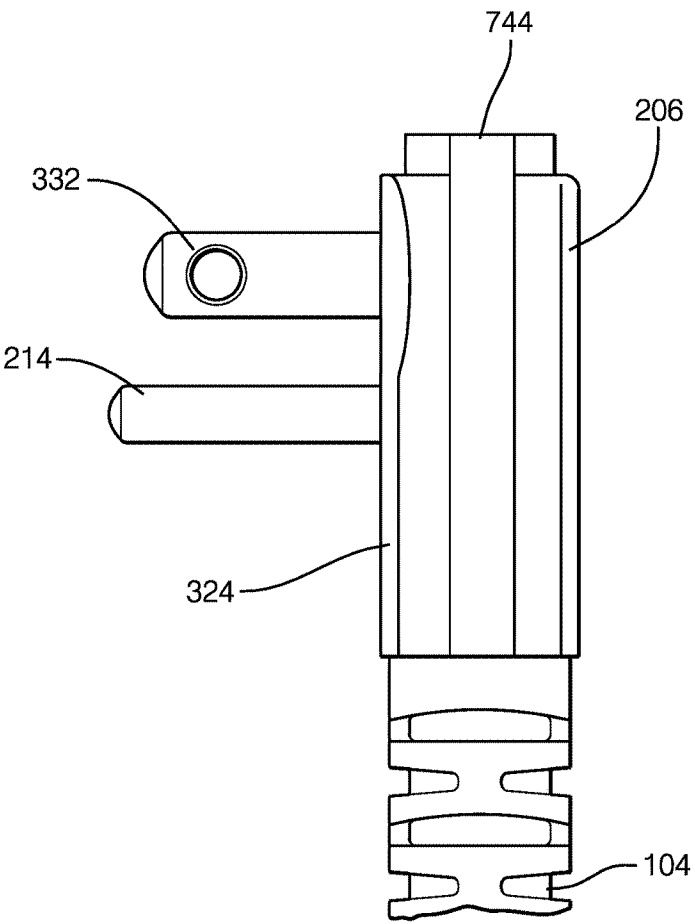
FIG. 7B is a side view of the electrical plug assembly including the first adapter plate.
Figure 7A:
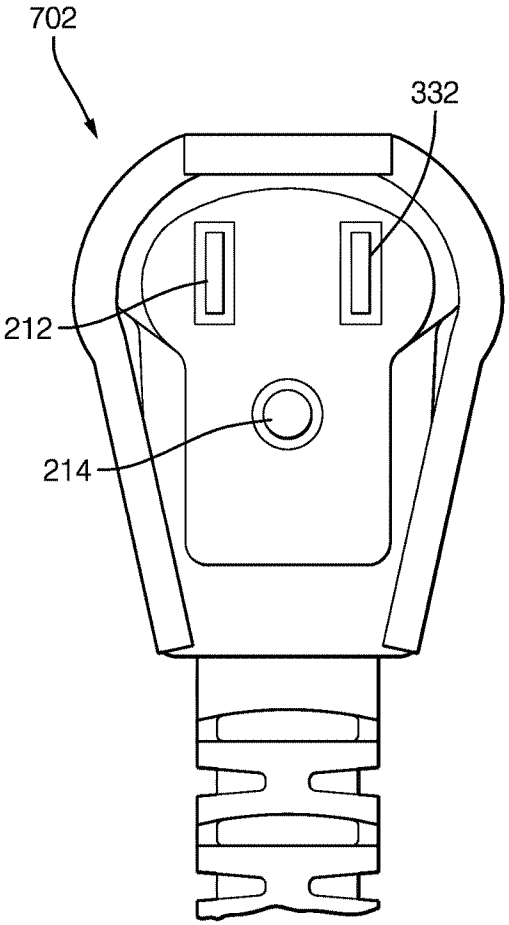
FIG. 7A is a front view of the electrical plug assembly including the first adapter plate.

FIGS. 7A and 7B illustrate the plug assembly 702 in a configuration that meets the NEMA 5-15P standards and is pluggable into a NEMA 5-15R compliant receptacle. Here, the plug housing 206 is mated with the first adapter plate 324. The first adapter plate 324 is secured to the plug housing 206 by a retainer 744 that snaps over the top of the plug housing 206 and the first adapter plate 324. The retainer 744 shown here is formed of a dielectric material, such as PBT. This retainer 744 provides the advantage of being installed and removed without the use of any tools other than a user's fingers. Alternatively, the retainer may be threaded fastener (conductive or non-conductive), a snap pin, or any other retaining device known to those skilled in the art.

Figure 8B:
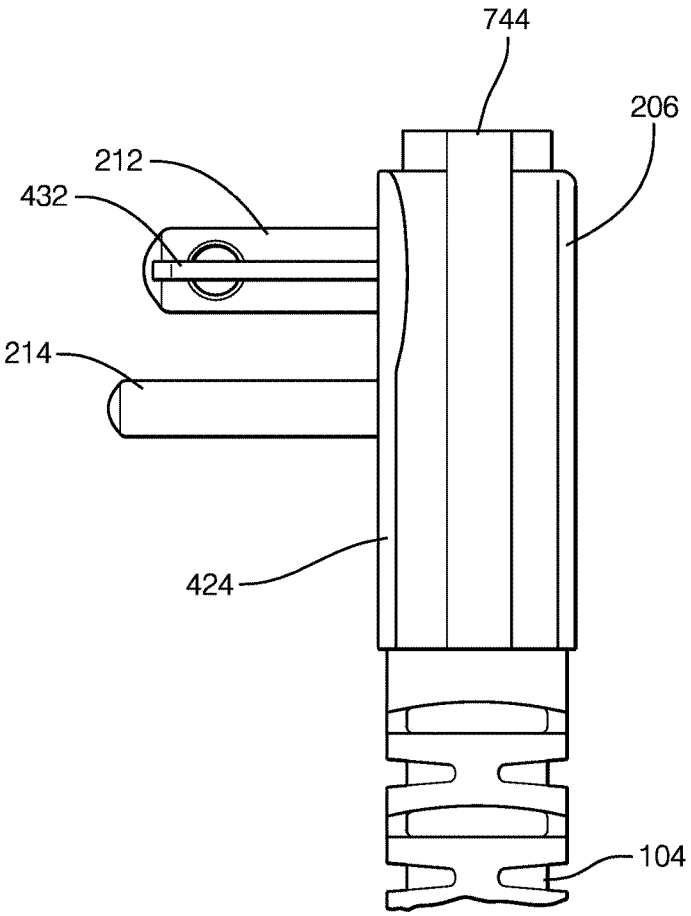
FIG. 8B is a side view of the electrical plug assembly including the second adapter plate.
Figure 8A:
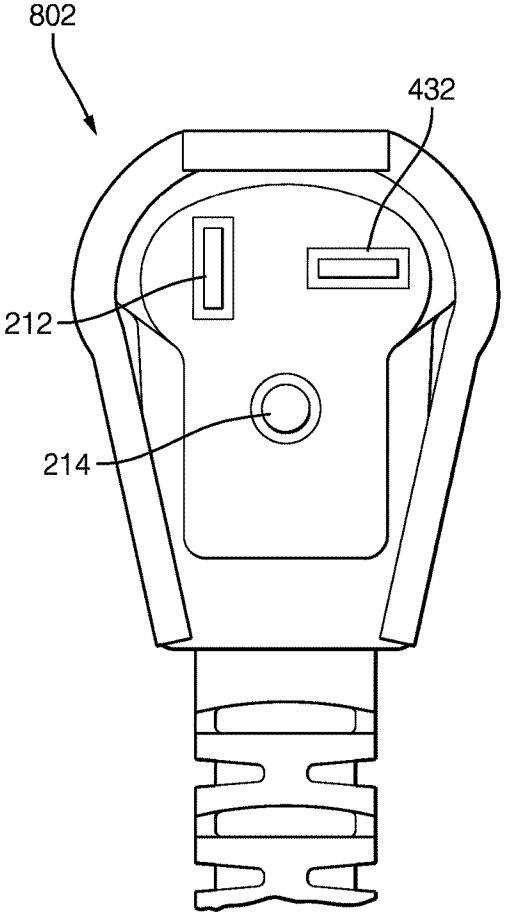
FIG. 8A is a front view of the electrical plug assembly including the second adapter plate.

FIGS. 8A and 8B illustrate the plug assembly 802 in a configuration that meets the NEMA 6-20P standards and is pluggable into a NEMA 6-20R compliant receptacle. Here, the plug housing 206 is mated with the second adapter plate 424. The second adapter plate 424 is secured to the plug housing 206 by the retainer 744.

Figure 9:
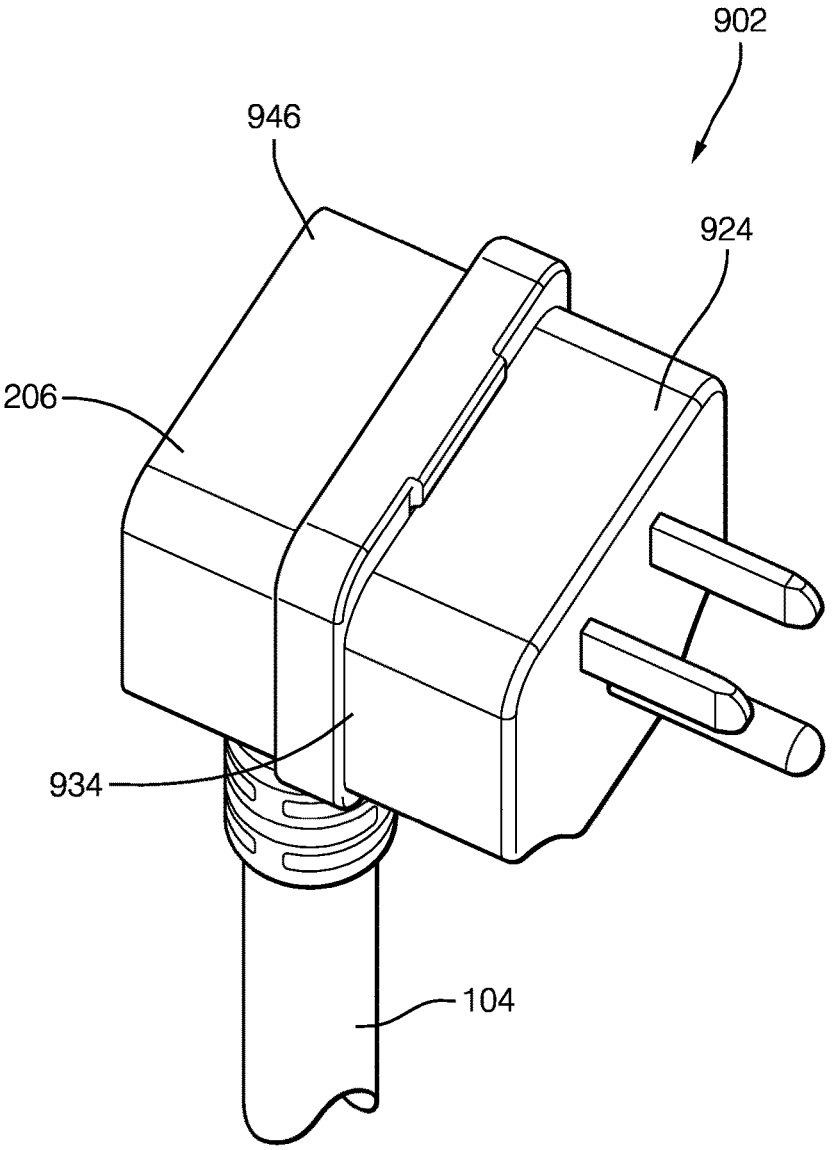
FIG. 9 is a perspective view of the first adapter plate of the electrical plug assembly including a fixed shroud.

FIG. 9 illustrates another alternative embodiment of the plug assembly 902 wherein the adapter plate 924 defines a fixed shroud 946 that receives the plug housing 206. The shroud 946 is configured to aid in the alignment of the adapter plate 924 onto the plug housing 206 during installation as well as aid in the process of removing the adapter plate 924 from the plug housing 206.

Figure 10B:
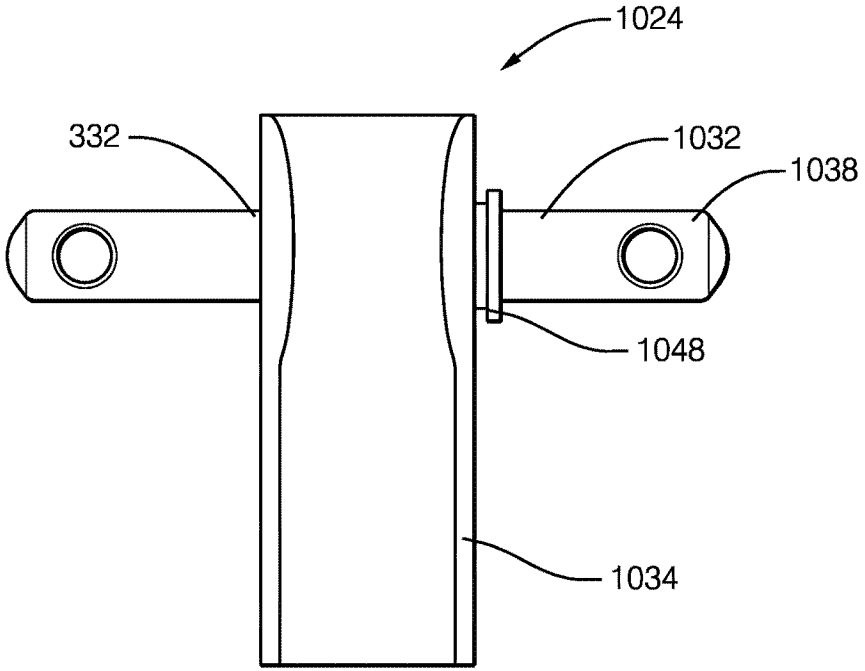
FIG. 10B is a side view of the first adapter plate of the electrical plug assembly showing the retractable shroud in a retracted condition.
Figure 10A:
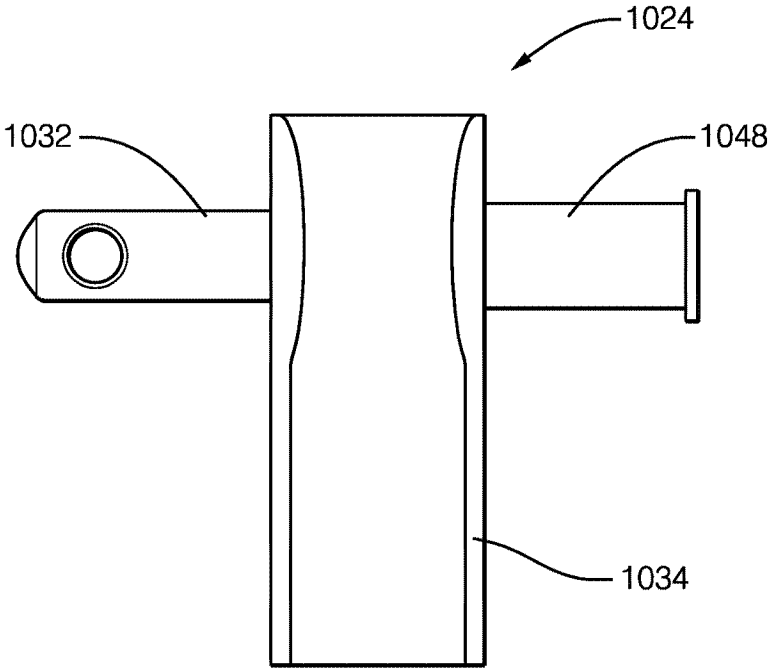
FIG. 10A is a side view of the first adapter plate of the electrical plug assembly including a retractable shroud.

FIGS. 10 A and 10B illustrate yet another alternative embodiment of the adapter plate 1024. As shown in FIG.

10A, the second surface 1034 defines a blade shroud 1048 that encloses the second portion 1038 of the second power blade 1032 when the adapter plate 1024 is not attached to the plug housing. This blade shroud 1048 is designed to prevent a user's finger from contacting the second portion 1038 of the second power blade 1032, especially as the second power blade 1032 is being plugged into the power socket 216 of the plug housing 206. This blade shroud 1048 is retractable. It is snapped into the adapter plate 1024 and covers the second portion 1038 of the second power blade 1032. During the process of assembling the adapter plate 1024 to the plug housing 206, the plug housing 206 releases a lock (not shown) and allows the blade shroud 1048 to retract into the adapter plate 1024 as shown in FIG. 10B. The thickness of the plug housing 206 is less than that of the adapter plate 1024, so the blade shroud 1048 is fully contained within the adapter plate 1024 when mated. When the adapter plate 1024 is removed from the plug housing 206, the blade shroud 1048 is pulled back into place to cover the exposed second portion 1038 of the second power blade 1032. The blade shroud 1048 may also be move back into place by a spring device.

Accordingly an electric vehicle battery charging device 100 with a power cord 104 having an adaptable electrical plug assembly 702, 802 is provided. The plug assembly 702, 802 includes removable adapter plates 324, 424 that allow the plug assembly 702, 802 to meet different technical standards for electrical plugs, such as NEMA 5-15P used with 110V/60 Hz AC power or NEMA 6-20P used with 220V/60 Hz AC power. Thus a single power cord 104 terminated by a plug housing 206 may be used with the adapter plates 324, 424 to supply either 110V or 220V AC power to the electric vehicle battery charging device 100. The adapter plates 324, 424 are configured so they may not be used with standard plugs, therefore the adapter plates 324, 424 cannot be used to connect an electrical device that is not designed for different source voltages into an improper receptacle. The snap fit retainer 744 allows the adapter plates 324, 424 to be changed without the use of any special tools. The adapter plates 1024 may include a retractable blade shroud 1048 that inhibits contact with the second portion 1038 of the second power blade 1032 until it is plugged into the power socket 216 of the plug housing 206. The plug assembly 702, 802 also provides the benefit of being more flush to a receptacle in which it is mated than a plug using a prior art plug adapter that defines both a plug and receptacle conforming to different technical specifications, e.g. a NEMA 5-15P plug and a NEMA 6-20R receptacle.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical plug assembly, comprising:

a plug housing;

a ground pin projecting from a surface of the plug housing;

a first power blade projecting from the surface of the plug housing;

a power socket disposed within the plug housing, configured to receive a second power blade in a first orientation substantially parallel to the first power blade or in a second orientation substantially perpendicular to the first power blade.

2. An electrical plug assembly, comprising:

a plug housing;

a ground pin projecting from a surface of the plug housing;

a first power blade projecting from the surface of the plug housing;

a power socket disposed within the plug housing, said surface defining an aperture surrounding the power socket; and an adapter plate including a second power blade having a first portion projecting from a first surface and a second portion projecting from an opposed second surface, said adapter plate further defining a ground pin aperture and a first power blade aperture extending there through, wherein the second portion of the second power blade is received within the power socket and the ground pin and the first power blade are received within the ground pin aperture and the first power blade aperture respectively and wherein the ground pin and the first power blade each project from the first surface of the adapter plate.

3. The electrical plug assembly according to claim 2, wherein the power socket is configured to receive a second power blade in a first orientation substantially parallel to the first power blade or in a second orientation substantially perpendicular to the first power blade.

4. The electrical plug assembly according to claim 3, wherein the second power blade is in the first orientation substantially parallel to the first power blade.

5. The electrical plug assembly according to claim 4, wherein the electrical plug assembly meets a National Electrical Manufacturers Association (NEMA) 5-15P standard.

6. The electrical plug assembly according to claim 3, wherein the second power blade is in the second orientation substantially perpendicular to the first power blade.

7. The electrical plug assembly according to claim 6, wherein the electrical plug assembly meets a NEMA 6-20P standard.

8. The electrical plug assembly according to claim 2, further comprising a retainer configured to secure the adapter plate to the plug housing.

9. The electrical plug assembly according to claim 2, wherein the adapter plate defines a shroud projecting from the second surface and longitudinally surrounding the second portion of the second power blade.

10. The electrical plug assembly according to claim 9, wherein the shroud is slideably attached to the adapter plate and configured to retract within the adapter plate when the adapter plate is attached to the plug housing.

11. An electric vehicle battery charging device capable of receiving electrical power having various source voltages, comprising an electrical power cord terminated by the electrical plug assembly according to claim 1.

12. An electrical plug adapter plate configured to connect with a plug housing having a ground pin projecting from a surface of the plug housing, a first power blade projecting from the surface of the plug housing and a power socket disposed within the plug housing, said electrical plug adapter comprising:

an adapter plate having a first surface and an opposed second surface; and a second power blade having a first portion projecting from the first surface and a second portion projecting from the second surface, wherein the adapter plate defines a ground pin aperture and a first power blade aperture extending there through, wherein the second portion of the second power blade is configured to be received within the power socket and wherein the ground pin aperture and the first power blade aperture are configured to receive the ground pin and the first power blade respectively.

13. The electrical plug adapter according to claim 12, wherein the power socket is configured to receive a second power blade within a first portion having in a first orientation or within a second portion having a second orientation substantially perpendicular to first orientation.

14. The electrical plug adapter plate according to claim 13, wherein the second power blade is configured to be received within the first portion of the power socket of the plug housing.

15. The electrical plug adapter plate according to claim 14, wherein the first portion of the second power blade meets second power blade requirements according to a NEMA 5-15P standard.

16. The electrical plug adapter plate according to claim 13, wherein the second power blade is configured to be received within the second portion of the power socket of the plug housing.

17. The electrical plug adapter plate according to claim 16, wherein the first portion of the second power blade meets second power blade requirements according to a NEMA 6-20P standard.

18. The electrical plug adapter plate according to claim 12, wherein the adapter plate defines a shroud projecting from the second surface and longitudinally surrounding the second portion of the second power blade.

19. The electrical plug adapter plate according to claim 18, wherein the shroud is slideably attached to the adapter plate and configured to retract within the adapter plate when the adapter plate is attached to the plug housing.

20. An electric vehicle battery charging device capable of receiving electrical power having various source voltages, comprising an electrical power cord terminated by the electrical plug assembly according to claim 2.

* * * * *